US007028756B2

(12) United States Patent
Ives et al.

(10) Patent No.: US 7,028,756 B2
(45) Date of Patent: Apr. 18, 2006

(54) APPARATUS FOR INCREASING A TRANSFER OF THERMAL ENERGY THROUGH AN INNER SURFACE OF A HOLLOW CYLINDRICAL DRYER OF A PAPERMAKING MACHINE

(75) Inventors: Alan T. Ives, Marcellus, MI (US); Gerald L. Timm, Schoolcraft, MI (US); Gregory L. Wedel, Kalamazoo, MI (US)

(73) Assignee: The Johnson Corporation, Three Rivers, MI (US)

( * ) Notice: Subject to any disclaimer, the term of this patent is extended or adjusted under 35 U.S.C. 154(b) by 196 days.

(21) Appl. No.: 10/151,407

(22) Filed: May 17, 2002

(65) Prior Publication Data

US 2003/0213584 A1 Nov. 20, 2003

(51) Int. Cl.
*F28D 11/02* (2006.01)

(52) U.S. Cl. ..... 165/89; 34/124; 492/65

(58) Field of Classification Search ..... 165/89, 165/90; 492/65; 34/124
See application file for complete search history.

(56) References Cited

U.S. PATENT DOCUMENTS

| | | | | |
|---|---|---|---|---|
| 1,640,019 A | * | 8/1927 | Young | 34/124 |
| 3,217,426 A | | 11/1965 | Barnschept et al. | |
| 3,724,094 A | | 4/1973 | Appel et al. | |
| 3,808,700 A | | 5/1974 | Kraus | |
| 4,195,417 A | | 4/1980 | Mathews | |
| 4,267,644 A | | 5/1981 | Schiel | |
| 4,282,656 A | | 8/1981 | Schiel | |
| 4,486,962 A | | 12/1984 | Wedel | |
| 4,538,360 A | | 9/1985 | Chance et al. | |
| 4,542,593 A | * | 9/1985 | Viitanen et al. | 34/124 |
| 4,674,196 A | * | 6/1987 | Means | 34/125 |
| 5,528,838 A | * | 6/1996 | Timm et al. | 34/124 |

FOREIGN PATENT DOCUMENTS

| | | | |
|---|---|---|---|
| GB | 2 032 056 | * | 10/1980 |
| JP | 63-165594 | * | 7/1988 |
| KR | 9307864 | * | 8/1993 |

OTHER PUBLICATIONS

Deublin—Sint "Turbulator Bars for Paper Industry"Italy 1995—Pub. —pp. 1-9—Bologna, Italy.

* cited by examiner

*Primary Examiner*—Teresa J. Walberg
(74) *Attorney, Agent, or Firm*—David J. Archer

(57) ABSTRACT

An apparatus is disclosed for increasing a transfer of thermal energy through an inner surface of a hollow cylindrical dryer of a papermaking machine to a peripheral outer surface of the dryer. The apparatus includes a plurality of bars of rectangular cross-sectional configuration, each of the bars extending axially within the dryer. The bars are disposed spaced and parallel relative to each other with each of the bars being urged outwardly against the inner surface of the dryer. Also, each of the bars defines an axially extending enclosure.

32 Claims, 6 Drawing Sheets

*Fig. 2.*
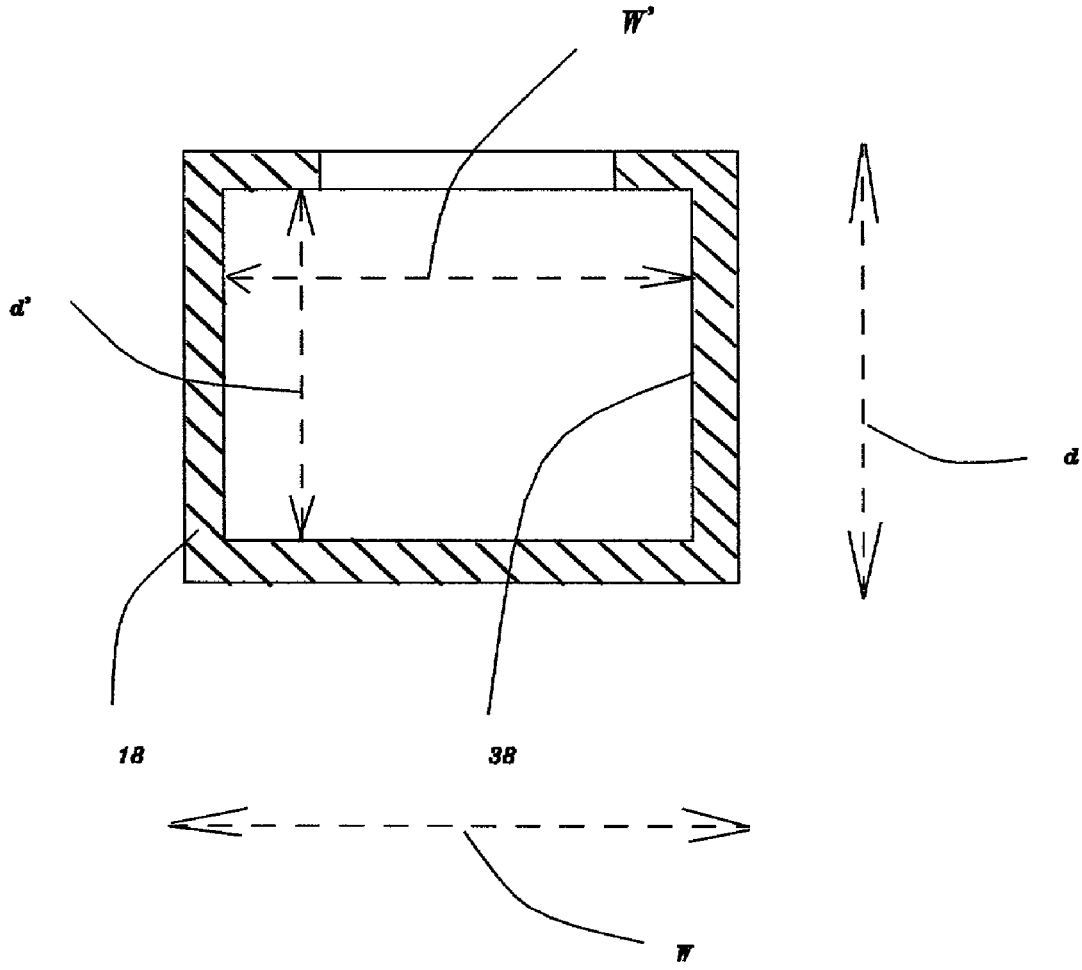
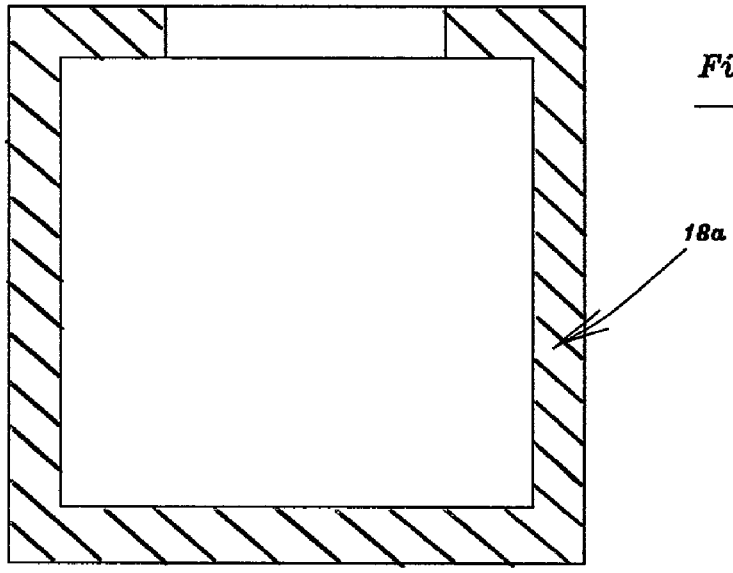
*Fig. 3.*

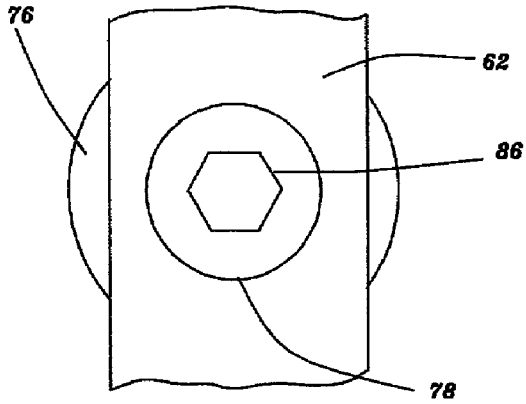
Fig. 6.
Fig. 7.
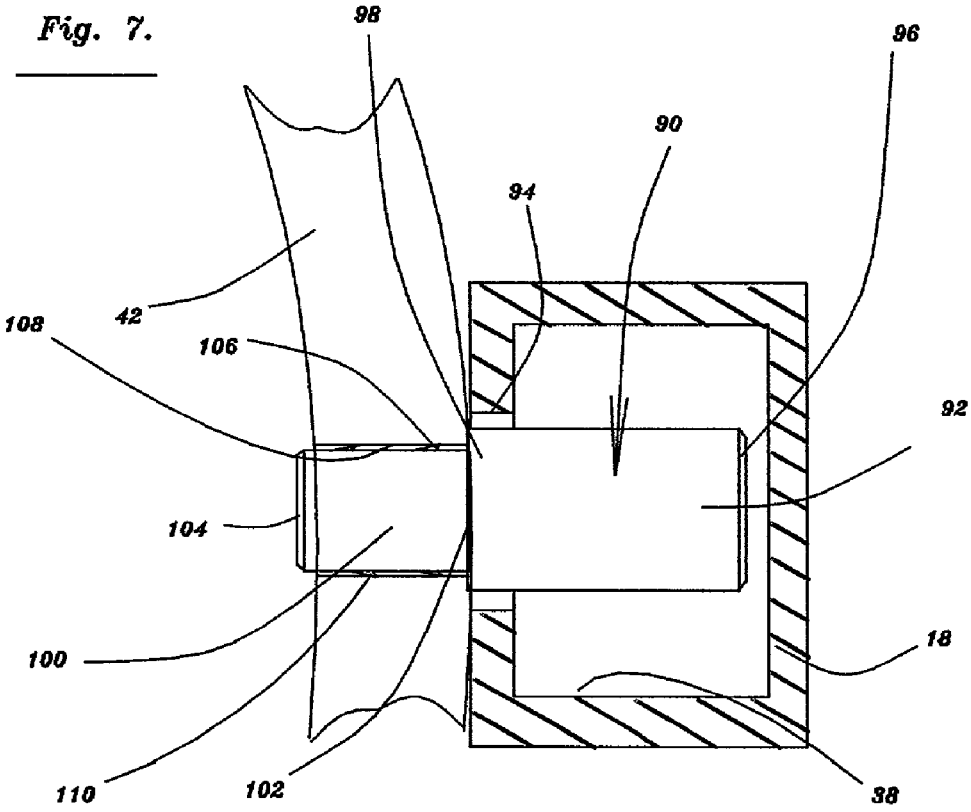

APPARATUS FOR INCREASING A TRANSFER OF THERMAL ENERGY THROUGH AN INNER SURFACE OF A HOLLOW CYLINDRICAL DRYER OF A PAPERMAKING MACHINE

BACKGROUND OF THE INVENTION

1. Field of the Invention

The present invention relates to an apparatus for increasing a transfer of thermal energy through an inner surface of a hollow cylindrical dryer of a papermaking machine.

More specifically, the present invention relates to an apparatus for increasing a transfer of thermal energy through an inner surface of a hollow cylindrical dryer of a papermaking machine to a peripheral outer surface of the dryer.

2. Background Information

Paper is normally dried by passing it over a series of steam-heated, cast iron dryer cylinders. These cylinders are typically 4', 5', or 6' in diameter, with some modern dryers being as large as 7' in diameter. The steam inside the dryer cylinders transfers its heat to the paper through the dryer shell. As the heat is transferred from the hot steam to the wet paper, the steam inside the dryer condenses. The condensate thus formed is then removed from the dryer cylinder through a syphon pipe connected to an external pipe or tank through a rotating seal.

At low rotational speeds, the residual condensate inside the dryer will tend to accumulate in a puddle in the bottom of the dryer cylinder, in a "ponding" state. As the dryer rotational speed increases, the condensate in this puddle will begin to rotate with the dryer shell, and then fall back into the puddle. This is normally referred to as the "cascading" state. At high dryer speeds, the condensate will follow the dryer cylinder around the entire periphery of the dryer shell, in a state that is called "rimming".

In order to minimize the power required to rotate the dryers in the ponding and cascading states, and to maximize the transfer of heat through the rimming condensate, the dryer syphons are normally designed to minimize the amount of condensate in the dryers.

At high speed, however, even thin residual layers of condensate can form a significant resistance to the transfer of heat from the steam to the dryer shell. At high speed, the rimming layer of condensate is very stagnant and forms an insulating barrier between the steam inside the rimming condensate layer and the inside surface of the dryer shell.

Dryer bars were developed to generate turbulence in the rimming layer, in order to increase the rate of convective heat transfer through the layer. Dryer bars consist of a series of solid metal bars that are located inside the dryer cylinder. The bars are held by various means against the inside surface of the dryer cylinder. The bars tend to generate turbulence in the rimming layer of condensate that forms between the individual bars. This increase in condensate turbulence increases the rate of heat transfer and also tends to improve the uniformity of heat transfer from the dryer cylinder.

The concept of dryer bars was first disclosed by Barnscheidt and Staud in U.S. Pat. No. 3,217,426. Specific formulae for predicting the optimum amount of condensate was later added by Appel and Hong as taught in U.S. Pat. No. 3,724,094. Several methods have since been developed for holding these bars to the inside surface of the dryer. One method, for example, uses a series of magnets to hold the bars to the dryer shell surface as described in Mathews U.S. Pat. No. 4,195,417. Another method uses a series of bars that are magnetic as disclosed by Wedel in U.S. Pat. No. 4,486, 962. Other methods have been disclosed by Kraus (U.S. Pat. No. 3,808,700), Schiel (U.S. Pat. No. 4,267,644), and Schiel (U.S. Pat. No. 4,282,656), using various types of springs and pins.

In each of these prior art arrangements, the bars have consisted of solid metal bars (normally mild steel, but sometimes stainless steel, for use in corrosive environments). Bars used in commercial embodiments have square or rectangular cross-sections, ranging from 0.25"×0.25" to as large as 0.5"×0.75". This cross-section is selected based on the number of rows of bars in the dryer, the amount of condensate that is expected to be rimming inside the dryer, the cost of the bars, the rigidity of the bars, and the ability to handle the bars during installation.

The weight of large cross-section bars makes their installation very difficult, particularly when installed inside existing papermaking dryers that are only 4–6' in diameter. Bars with small cross-section are much easier to handle, but do not have the structural rigidity to withstand long periods of tumbling of condensate inside the dryer.

Most papermaking dryers have removable cast ports in the front (tending side) head. These ports ("manholes") are removed to provide access for inspecting the inside of the dryer cylinders and for installing and maintaining syphon equipment. To avoid the very difficult task of removing the dryer heads, dryer bar equipment must fit through these manholes in order to be installed in existing dryer cylinders. This limits the design of the apparatus for holding the bars in place.

Further, modern papermaking machines produce paper up to 400" in width, running at speeds approaching 6,000 feet per minute. These machines can produce over 1,000 tons of paper per day. The cost of having these machines idled for installation of dryer bars can be very high, often exceeding $15,000 per hour. A reduction in the time required to install dryer bars inside existing dryer cylinders can provide a very significant reduction in the idle time for the machine. Despite this incentive for short installation times, the time required to install prior art dryer bars is still typically 1.5–2.5 hours per drying cylinder. Prior art methods have not provided significant reductions to this installation time.

Most prior art bars are held against the dryer shell using a series of hoop segments. In order to hold the bars tightly against the dryer shell, these hoop segments must be pressed toward the shell surface. In the prior art designs, this force is developed by installing various systems between flanges at the end of the hoop segments, to force the segments apart.

One of these systems is a simple threaded turnbuckle with locking nuts. These turnbuckles are tightened using a pair of open-end wrenches. This is a time-consuming process. The rigid turnbuckles do not provide much resilience to allow for the differential thermal expansion of the dryer shell, with respect to the dryer bar hoops. Without a method for allowing for differential thermal expansion, the stress in the turnbuckle, the stress in the hoop segments, and the stress on the dryer shell will increase. This can cause deformation and long-term loosening of the hoop assembly.

A more sophisticated design uses various types of springs between the hoop segments. These springs have alternately been coil springs, cylindrical springs, and Bellville washers. These springs maintain the design force of the segments against the bars as the dryer is heated up, but the time required to install these systems is much longer. There are more parts to handle and additional hand tools are needed for their installation.

The prior art bars are attached to the hoop segments to prevent them from shifting in the circumferential direction.

The bars are normally attached with small threaded fasteners (capscrews). These fasteners require some mechanism to lock them in place, so that they do not come loose inside the dryer cylinder. The locking mechanisms used in prior art dryers include split washers, Bellville washers, flanged self-locking fasteners (WhizLock), and groove lock pins. The threaded fasteners can be difficult to align during installation. It can be difficult to get the fastener started in the threaded holes in the bars, and self-tapping screws can be easily broken. Small diameter pins can be difficult to align, they are easy to break off, and they can come loose inside the dryer.

The present invention provides a method and apparatus for improving the drying capacity of steam-heated cylinders, and in particular cylindrical dryers in a papermaking machine, the apparatus utilizing a series of bars disposed in a generally axial direction inside and adjacent to the shell of the dryer cylinders. The invention more specifically provides for an apparatus which includes hollow rectangular bars, means for holding the bars against the dryer shell, and a method of installing the apparatus. The means for holding includes a fastening system for the bars. The fastening system includes, in combination, a series of hoop segments that are coupled together with special fasteners, a series of bars that are coupled to the hoop segments with special pins, and a unique bar geometry to reduce the time and effort required for their installation.

The dryer bars of the present invention provide a stiffer structure with a lighter weight than existing bar configurations. The apparatus of the present invention can reduce the installation time by approximately a factor of 3. The construction is low in cost and the bar geometry provides heat transfer that equals or exceeds that of the prior art dryer bar configurations.

In order to reduce the weight of the dryer bars, the bars of the present invention are hollow rectangular tubes. These tubes are much lower in weight with much higher bending stiffness than the prior art bars. This greatly improves the ease of handling the bars for installation and makes them less susceptible to bending when subjected to the impact forces of tumbling condensate.

For example, the weight of a typical 0.5×0.75" solid steel cross-section dryer bar that is 6' in length is 7.6 pounds. The installation crew must handle 138 pounds of steel bars to install a segment with 18 rows of bars. The weight of one of the bars of the present invention (preferred size is 0.75"× 1.00" with a 0.065" wall thickness) is only 4.3 pounds and the installation crew must handle only 77 pounds during the installation of a similar segment with 18 rows of bars.

Also, the stiffness of the bars of the present invention is significantly increased. The moment of inertia of the prior art bars in the previous example would be 0.008 $in^4$ in the radial direction and 0.018 $in^4$ in the circumferential direction. By comparison, the moment of inertia of the bars of the present invention, for the preferred size, is be 0.018 $in^4$ in the radial direction and 0.029 $in^4$ in the circumferential direction, that is, 130% stiffer in the radial direction and 60% stiffer in the circumferential direction. All while being lighter in weight.

The bars of the present invention are held against the dryer shell using a series of hoop segments, as is done in most prior art configurations. In order to hold the bars tightly against the dryer shell, these hoop segments are pressed toward the shell surface with a unique threaded fastener. This fastener system consists of a threaded fastener and a threaded nut. The head of the fastener extends through a hole in the end of the hoop segment. This head holds the fastener in place during installation and during operation. The head of the fastener has a socket head. However, the head could alternatively have an external hex shaped configuration. This allows the fastener to be turned using either manual or automatic (electric or pneumatic) ratchets to tighten the fastener, pressing the threaded nut against the flange on the adjacent hoop segment. This greatly speeds up the installation process.

The bars of the present invention are held to the hoop segments using large-diameter pins. These pins are installed in the hoop segment prior to the installation of the bars. This eliminates the time required to find, start, and then engage conventional pins and threaded fasteners. These pins also have a shoulder that prevents them from coming out of the hoop segment, even after the segment has been in service for many years.

A portion of the normal differential thermal expansion between the dryer shell and the bar assembly is absorbed by the radial flexibility of the hollow rectangular tube bars. This, coupled with the flexibility of the hoop segments, allows the bar assembly to handle normal differential thermal expansion without the need for complex systems of springs or flexible hoop couplings.

Because the bars are lighter in weight for a given cross-section, the overall cross-section of the tube bars can be increased to values larger than would be practical with solid bars. This allows the selection of larger bars to optimize the generation of turbulence in the rimming condensate, to gain the maximum heat transfer.

The tube bars can also be manufactured economically in stainless steel, for dryers in which corrosion is a problem. The high cost of stainless steel normally precludes the use of stainless with solid dryer bars, except for very special applications where the high cost would be acceptable. With the lower cross-sectional area of material, stainless steel can be used in place of mild steel while retaining costs that are competitive with respect to solid mild steel bars.

Therefore, it is a primary feature of the present invention to provide an apparatus for increasing a transfer of thermal energy through an inner surface of a hollow cylindrical dryer of a papermaking machine that offers improvemements in performance over that provided by the prior art arrangements.

Another feature of the present invention is the provision of an apparatus for increasing a transfer of thermal energy through an inner surface of a hollow cylindrical dryer of a papermaking machine that is relatively easy to manufacture.

A further feature of the present invention is the provision of an apparatus for increasing a transfer of thermal energy through an inner surface of a hollow cylindrical dryer of a papermaking machine that is of relatively low cost.

Another feature of the present invention is the provision of an apparatus for increasing a transfer of thermal energy through an inner surface of a hollow cylindrical dryer of a papermaking machine that is very easy to install.

Other features and advantages of the present invention will be readily apparent to those skilled in the art by a consideration of the detailed description of a preferred embodiment of the present invention contained herein.

SUMMARY OF THE INVENTION

The present invention relates to an apparatus for increasing a transfer of thermal energy through an inner surface of a hollow cylindrical dryer of a papermaking machine to a peripheral outer surface of the dryer. The apparatus includes a plurality of bars of rectangular cross-sectional configuration, each of the bars extending axially within the dryer. The bars are disposed spaced and parallel relative to each other with each of the bars being urged radially outward against the inner surface of the dryer. Also, each of the bars defines an axially extending enclosure.

In a more specific embodiment of the present invention, each of the bars is fabricated from metallic material. More particularly, each of the bars is fabricated from steel. The steel in one embodiment is low-carbon steel and in a preferred embodiment, the steel is stainless steel.

Moreover, the plurality of bars is within a range of 12 to 30 bars and more specifically, within a range of 15 to 24 bars.

In one embodiment, the plurality of bars is 18 bars and in another embodiment, the plurality of bars is 21 bars.

Preferably, the plurality of bars is within a range which is 3 to 4 times an outside diameter of the dryer when the outside diameter is expressed in feet. Also, each of the bars is equally spaced relative to an adjacent bar.

Each of the bars has a cross-sectional dimension within a range of 0.25" width by 0.25" depth to 1.50" width by 1.00" depth. In one embodiment, each of the bars has a square cross-sectional configuration.

Additionally, each of the bars has an outside width and an outside depth and an inside width and an inside depth. The arrangement is such that:

1) a total cross-sectional area of a bar is a product of the outside width and the outside depth. Also, 2) a cross-sectional area of the enclosure is a product of the inside width and the inside depth. Therefore, 3) a cross-sectional area of the metallic bar is the total cross-sectional area (1) less the cross-sectional area (2) of the enclosure. The arrangement is structured such that the cross-sectional area (3) of the metallic bar is at least alternatively 25%, 50% and 75% respectively less than the total cross-sectional area (1).

The apparatus also includes a mechanism for urging each of the bars radially outward against the inner surface of the dryer More particularly, the mechanism includes a plurality of hoop rings which are spaced axially within the dryer, each hoop ring being disposed normal to an axis of rotation of the dryer.

Moreover, each hoop ring includes a plurality of segments. The plurality of segments include a first segment which includes a first arm extending in a direction from the inner surface of the dryer generally towards the axis of rotation of the dryer, the first arm defining a first orifice. A second arm extends in a direction from the inner surface of the dryer generally towards the axis of rotation of the dryer, the second arm defining a second orifice. A second segment has a first limb which extends in a direction from the inner surface of the dryer generally towards the axis of rotation of the dryer. The first limb defines a first aperture. A second limb extends in a direction from the inner surface of the dryer generally towards the axis of rotation of the dryer. The second limb defines a second aperture.

Also, an adjuster has a first and a second end, the adjuster extending through and being guided by the second orifice of the first segment and the first aperture of the second segment. The arrangement is such that the first end of the adjuster is disposed adjacent to the second orifice and the second end of the adjuster is disposed adjacent to the first aperture.

In a preferred embodiment of the present invention, each hoop ring includes three segments.

Additionally, the adjuster further includes a radially extending collar which is disposed between the first and second ends of the adjuster. The collar bears against the first limb when the second end of the adjuster is extending through the first aperture. A guide portion extends between the collar and the second end of the adjuster for guiding the second end of the adjuster within the first aperture. A threaded portion extends between the collar and the first end of the adjuster such that the threaded portion extends through the second orifice. A movable member threadably cooperates with the threaded portion so that the movable member bears against the second arm when the threaded portion extends through the second orifice. The arrangement is such that when the threaded portion is rotated relative to the movable member, the movable member and the collar move away from each other so that the second arm of the first segment is urged away from the first limb of the second segment such that the hoop ring is expanded for urging each of the bars outwardly away from the axis of rotation of the dryer towards the inner surface of the dryer.

The guide portion defines a socket structured for receiving therein a driving attachment of a power tool. Alternatively, the guide portion defines an external hex type arrangement structured for receiving thereover a driving attachment of a power tool.

The apparatus also includes a pin which extends between a bar of the plurality of bars and an adjacent hoop ring of the plurality of hoop rings for supporting the bar relative to the hoop ring.

More specifically, the pin includes a first portion for insertion thereof within a hole defined by the bar. The first portion has a first and a second extremity such that when the first extremity of the first portion is inserted into the hole, the first portion is disposed within the enclosure and the second extremity of the first portion is disposed adjacent to the hole. A second portion of the pin has a first and a second end and an outer surface, the second portion extending from the second extremity of the first portion. The second portion is inserted into a further hole defined by the hoop ring.

In a first embodiment of the present invention, the outer surface of the second portion defines at least one barb which engages the further hole of the hoop ring when the second portion is inserted therein so that connection of the bar to the hoop ring is permitted.

In a second embodiment of the present invention, the outer surface of the second portion defines at least one groove lock which engages the further hole of the hoop ring when the second portion is inserted therein so that connection of the bar to the hoop ring is permitted.

In a third embodiment of the present invention, the outer surface of the second portion provides an interference fit with the further hole of the hoop ring when the second portion is inserted therein so that connection of the bar to the hoop ring is permitted.

Moreover, the first portion has a greater diameter than the second portion so that when the second portion is inserted into the further hole of the hoop ring, insertion of the first portion of the pin into the further hole of the hoop ring is inhibited.

Also, the first portion has a diameter of at least 0.25" and preferably has a diameter which is equal to the thickness of the hoop rings. In one specific arrangement, the diameter is 0.375".

The present invention also includes a method for installing a plurality of hollow rectangular bars inside a dryer cylinder of a papermaking machine such that the bars extend parallel and spaced relative to each other so that the bars extend axially within the cylinder. The method includes the steps of inserting pins into unconnected segments of a hoop ring. The segments are then located within the dryer cylinder. Next, a plurality of hollow bars are located within the dryer cylinder.

The pins are then inserted within corresponding holes defined by the bars so that a segment and corresponding bars are connected to each other. An adjuster is disposed between adjacent segments so that the adjacent segments with the adjuster therebetween cooperate together to generate the hoop ring, the bars being disposed between the hoop ring and an inner surface of the dryer cylinder. At least one of the adjusters is rotated so that the hoop ring is expanded for urging the bars against the inner surface of the dryer cylinder.

The step of positioning the adjuster further includes positioning an adjuster between adjacent lower segments of the hoop ring and subsequently, positioning further adjusters between the lower segments and at least one upper segment for completing the hoop ring.

Also, the step of inserting the pins within corresponding holes defined by the bars further includes, pulling the segment away from the inner surface of the dryer cylinder by a distance such that the pins are located adjacent to corresponding holes defined by the bars for facilitating engagement of the pins within such holes while preventing pins which have previously been located and engaged within corresponding holes from becoming disengaged from such holes.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

FIG. 2 is an enlarged cross sectional view of one of the bars shown in FIG. 1;

FIG. 3 is a similar view to that shown in FIG. 2 but shows a bar having a square cross-sectional configuration;

FIG. 6 is an enlarged view taken on the line 6—6 of FIG. 5;

FIG. 7 is an enlarged side elevational view partially in section of one of the bars shown in FIG. 1 attached to one of the hoop rings;

Similar reference characters refer to similar parts throughout the various embodiments and views of the drawings.

DETAILED DESCRIPTION OF THE DRAWINGS

Figure 1:
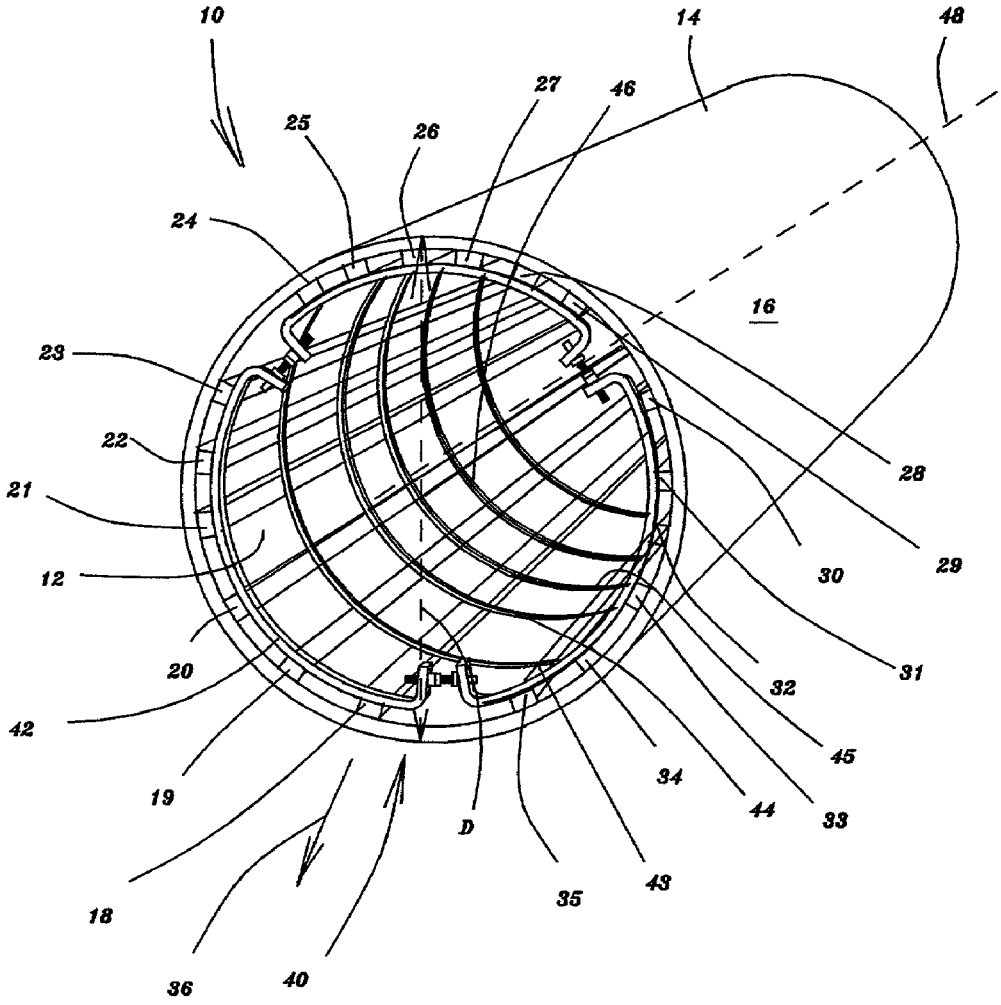
FIG. 1 is a perspective view of an apparatus according to the present invention.

FIG. 1 is a perspective view of an apparatus generally designated 10 according to the present invention. As shown in FIG. 1, the apparatus 10 is provided for increasing a transfer of thermal energy through an inner surface 12 of a hollow cylindrical dryer 14 of a papermaking machine to a peripheral outer surface 16 of the dryer 14. The apparatus 10 includes a plurality of bars 18, 19, 20, 21, 22, 23, 24, 25, 26, 27, 28, 29, 30, 31, 32, 33, 34 and 35 of rectangular cross-sectional configuration, each of the bars 18–35 extending axially within the dryer 14. The bars 18–35 are disposed spaced and parallel relative to each other with each of the bars 18–35 being urged radially outward against the inner surface 12 of the dryer 14 as indicated by the arrow 36.

FIG. 2 is an enlarged cross sectional view of one of the bars 18–35 such as bar 18. As shown in FIG. 2, the bar 18 defines an axially extending enclosure 38.

In a more specific embodiment of the present invention, each of the bars 18–35 is fabricated from metallic material. More particularly, each of the bars 18–35 is fabricated from steel. In one embodiment of the present invention the steel is low-carbon steel and in a preferred embodiment of the present invention, the steel is stainless steel.

Moreover, the plurality of bars is within a range of 12 to 30 bars and more specifically, within a range of 15 to 24 bars.

In the embodiment shown in FIG. 1, the plurality of bars is 18 bars and in another embodiment (not shown) the plurality of bars is 21 bars.

Preferably, the plurality of bars 18–35 is within a range which is 3 to 4 times an outside diameter D of the dryer 14 when the outside diameter D is expressed in feet as shown in FIG. 1. For example, for a 6' diameter dryer, the number of bars would be 18 to 24 Also, each of the bars such as bar 18 is equally spaced relative to an adjacent bar such as bar 19.

As shown in FIG. 2, each of the bars such as bar 18 has a cross-sectional dimension within a range of 0.25" in width W by 0.25" in depth d to 1.50" in width W by 1.00" in depth d.

FIG. 3 is a similar view to that shown in FIG. 2 but shows a bar 18*a* having a square cross-sectional configuration.

As shown in FIG. 2, each of the bars such as bar 18 has an outside width W and an outside depth d and an inside width W' and an inside depth d'. The arrangement is such that:

1) a total cross-sectional area of a bar 18 is a product of the outside width W and the outside depth d.
2) a cross-sectional area of the enclosure 38 is a product of the inside width W' and the inside depth d'. Therefore:
3) a cross-sectional area (shown in cross hatch in FIG. 2) of the metallic bar 18 is the total cross-sectional area (1) less the cross-sectional area (2) of the enclosure 38.

The arrangement is structured such that the cross-sectional area (3) of the metallic bar 18 is at least alternatively 25%, 50% and 75% respectively less than the total cross-sectional area (1).

As shown in FIG. 1, the apparatus 10 also includes a mechanism generally designated 40 for urging each of the bars 18–35 outwardly as indicated by the arrow 36 against the inner surface 12 of the dryer 14.

More particularly, the mechanism 40 includes a plurality of hoop rings 42, 43, 44, 45 and 46 spaced axially within the dryer 14, each hoop ring 42–46 being disposed normal to an axis of rotation 48 of the dryer 14.

Figure 4:
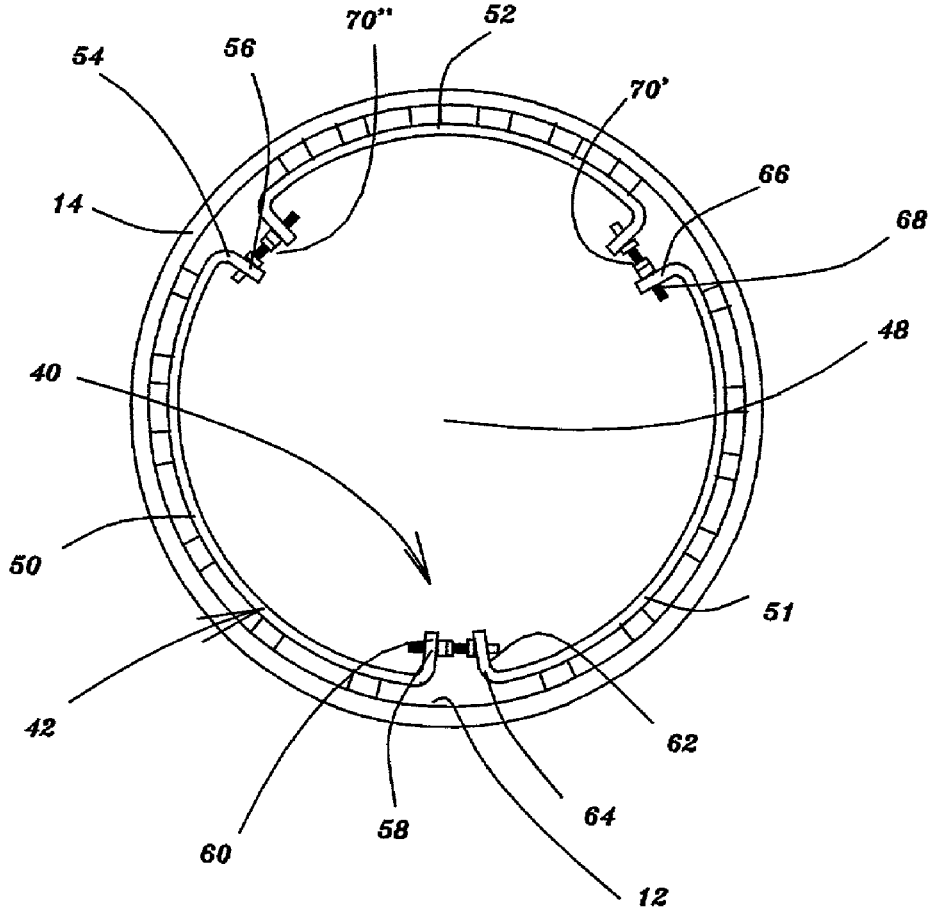
FIG. 4 is an enlarged side elevational view of one of the hoop rings shown in FIG. 1.

FIG. 4 is an enlarged side elevational view of the hoop ring 42. As shown in FIG. 4, the hoop ring 42 includes a plurality of segments 50, 51 and 52. The plurality of segments 50–52 includes a first segment 50 which includes a first arm 54 extending in a direction from the inner surface 12 of the dryer 14 generally towards the axis of rotation 48 of the dryer 14, the first arm 54 defining a first orifice 56. A second arm 58 extends in a direction from the inner surface 12 of the dryer 14 generally towards the axis of rotation 48 of the dryer 14, the second arm 58 defining a second orifice 60. The second segment 51 has a first limb 62 which extends in a direction from the inner surface 12 of the dryer 14 generally towards the axis of rotation 48 of the dryer 14. The first limb 62 defines a first aperture 64. A second limb 66 extends in a direction from the inner surface 12 of the dryer 14 generally towards the axis of rotation 48 of the dryer 14. The second limb 66 defines a second aperture 68.

Figure 5:
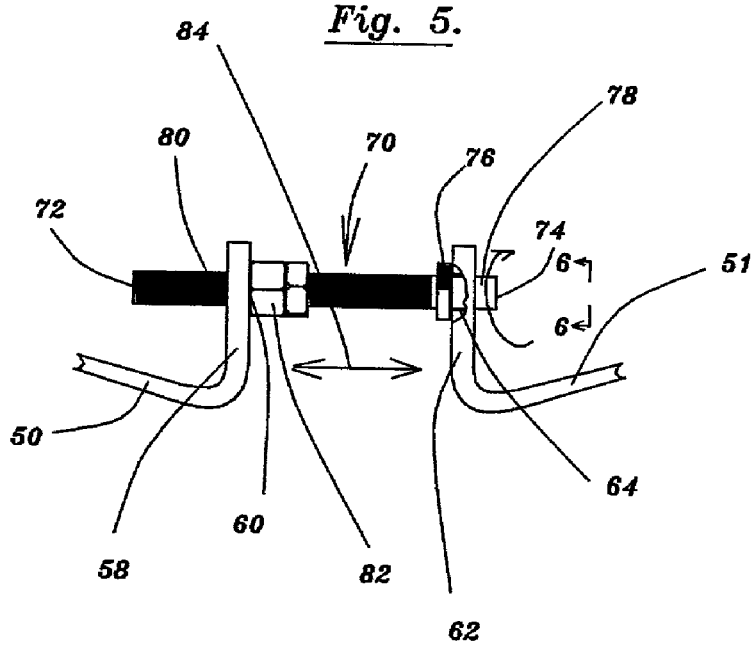
FIG. 5 is an enlarged view of the mechanism shown in FIG. 4.

FIG. 5 is an enlarged view of the mechanism 40 shown in FIG. 4. As shown in FIG. 5, an adjuster generally designated 70 has a first and a second end 72 and 74 respectively. The adjuster 70 extends through and is guided by the second orifice 60 of the first segment 50 and the first aperture 64 of the second segment 51. The arrangement is such that the first end 72 of the adjuster 70 is disposed adjacent to the second orifice 60 and the second end 74 of the adjuster 70 is disposed adjacent to the first aperture 64.

In a preferred embodiment of the invention, each hoop ring 42–46 includes three segments 50–52 as shown in FIG. 4.

Additionally, as shown in FIG. 5, the adjuster 70 further includes a radially extending collar 76 which is disposed between the first and second ends 72 and 74 respectively of the adjuster 70. The collar 76 bears against the first limb 62 when the second end 74 of the adjuster 70 is extending through the first aperture 64. A guide portion 78 extends between the collar 76 and the second end 74 of the adjuster 70 for guiding the second end 74 of the adjuster 70 within the first aperture 64. A threaded portion 80 extends between the collar 76 and the first end 72 of the adjuster 70 such that the threaded portion 80 extends through the second orifice 60. A movable member 82 threadably cooperates with the threaded portion 80 so that the movable member 82 bears against the second arm 58 when the threaded portion 80 extends through the second orifice 60. The arrangement is such that when the threaded portion 80 is rotated relative to the movable member 82, the movable member 82 and the collar 76 move away from each other as indicated by the arrow 84 so that the second arm 58 of the first segment 50 is urged away from the first limb 62 of the second segment 51 such that the hoop ring 42 is expanded for urging each of the bars 18–35 outwardly as indicated by the arrow 36, (shown in FIG. 1), away from the axis of rotation 48 of the dryer 14 towards the inner surface 12 of the dryer 14.

FIG. 6 is an enlarged view taken on the line 6—6 of FIG. 5. As shown in FIG. 6, the guide portion 78 defines a socket 86 structured for receiving therein a driving attachment of a power tool (not shown). When the driving attachment is driven, the threaded portion 80 is rotated relative to the movable member 82.

FIG. 7 is an enlarged side elevational view partially in section of one of the bars attached to one of the hoop rings 42. As shown in FIG. 7, the apparatus 10 also includes a pin generally designated 90 which extends between a bar such as bar 18 of the plurality of bars 18–35 and an adjacent hoop ring such as hoop ring 42 of the plurality of hoop rings 42–46 for supporting the bar 18 relative to the hoop ring 42 as shown in FIG. 1.

As shown in FIG. 7, the pin 90 includes a first portion 92 for insertion thereof within a hole 94 defined by the bar 18. The first portion 92 has a first and a second extremity 96 and 98 respectively such that when the first extremity 96 of the first portion 92 is inserted into the hole 94, the first portion 92 is disposed within the enclosure 38 and the second extremity 98 of the first portion 92 is disposed adjacent to the hole 94.

A second portion 100 of the pin 90 has a first and a second end 102 and 104 respectively and an outer surface 106, the second portion 100 extending from the second extremity 98 of the first portion 92. The second portion 100 is inserted into a further hole 108 defined by the hoop ring 42.

In a first embodiment of the present invention as shown in FIG. 7, the outer surface 106 of the second portion 100 defines at least one barb 110 which engages the further hole 108 when the second portion 100 is inserted therein so that connection of the bar 18 to the hoop ring 42 is permitted.

Figure 8:
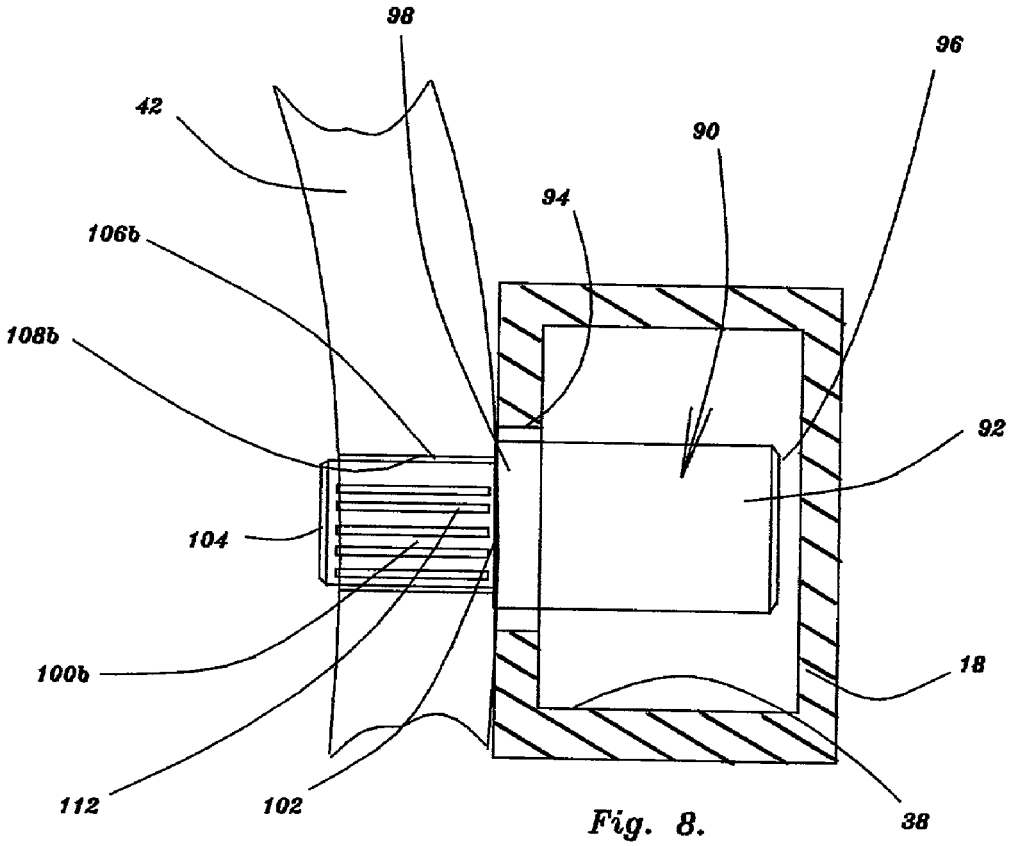
FIG. 8 is a similar view to that shown in FIG. 7 but shows another embodiment of the present invention.

FIG. 8 is a similar view to that shown in FIG. 7 but shows a second embodiment of the present invention. As shown in FIG. 8, the outer surface 106*b* of the second portion 100*b* defines at least one groove lock 112 which engages the further hole 108*b* when the second portion 100*b* is inserted therein so that connection of the bar 18 to the hoop ring 42 is permitted.

Figure 9:
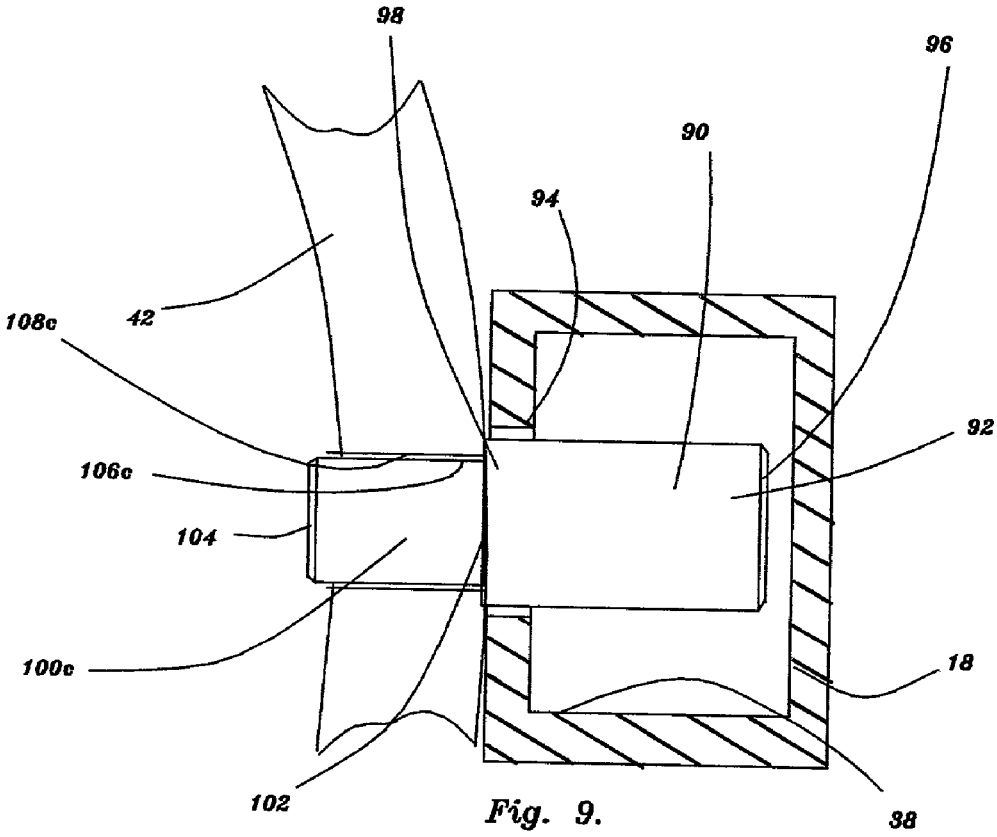
FIG. 9 is a similar view to that shown in FIG. 7 but shows a further embodiment of the present invention.

FIG. 9 is a similar view to that shown in FIG. 7 but shows a third embodiment of the present invention. As shown in FIG. 9, the outer surface 106*c* of the second portion 100*c* is an interference fit with the further hole 108*c* when the second portion 100*c* is inserted therein so that connection of the bar 18 to the hoop ring 42 is permitted.

Moreover, as shown in FIG. 7, the first portion 92 has a greater diameter than the second portion 100 so that when the second portion 100 is inserted into the further hole 108 of the hoop ring 42, insertion of the first portion 92 of the pin 90 into the further hole 108 of the hoop ring 42 is inhibited.

Also, the first portion 92 has a diameter of at least 0.25" and preferably has a diameter which is equal to the thickness of the hoop rings.

The present invention also includes a method for installing a plurality of hollow rectangular bars 18–35 inside a cylindrical dryer 14 of a papermaking machine such that the bars 18–35 extend parallel and spaced relative to each other so that the bars 18–35 extend axially within the dryer 14. The method includes the steps of inserting pins such as pin 90 into unconnected segments 50, 51 and 52 of a hoop ring such as hoop ring 42. The segments 50–52 are then located within the dryer 14. Next, the plurality of hollow bars 18–35 are located within the dryer 14.

The pins 90 are then inserted within corresponding holes such as hole 94 defined by the bar such as bar 18 so that a segment such as segment 50 and corresponding bars 18–23 are connected to each other. An adjuster 70 is disposed between adjacent segments such as segments 50 and 51 so that the adjacent segments 50 and 51 with the adjuster 70 therebetween cooperate together to generate the hoop ring 42, the bars 18–35 being disposed between the hoop ring 42 and the inner surface 12 of the dryer 14. At least one of the adjusters 70 is rotated by the driving attachment so that the hoop ring 42 is expanded for urging the bars 18–35 against the inner surface 12 of the dryer 14.

Additionally, the step of positioning the adjuster 70 further includes positioning the adjuster 70 between adjacent lower segments 50 and 51 of the hoop ring 42 and subsequently, positioning further adjusters 70' and 70" as shown in FIG. 4, between the lower segments 50 and 51 and at least one upper segment 52 as shown in FIG. 4 for completing the hoop ring 42.

Figure 10:
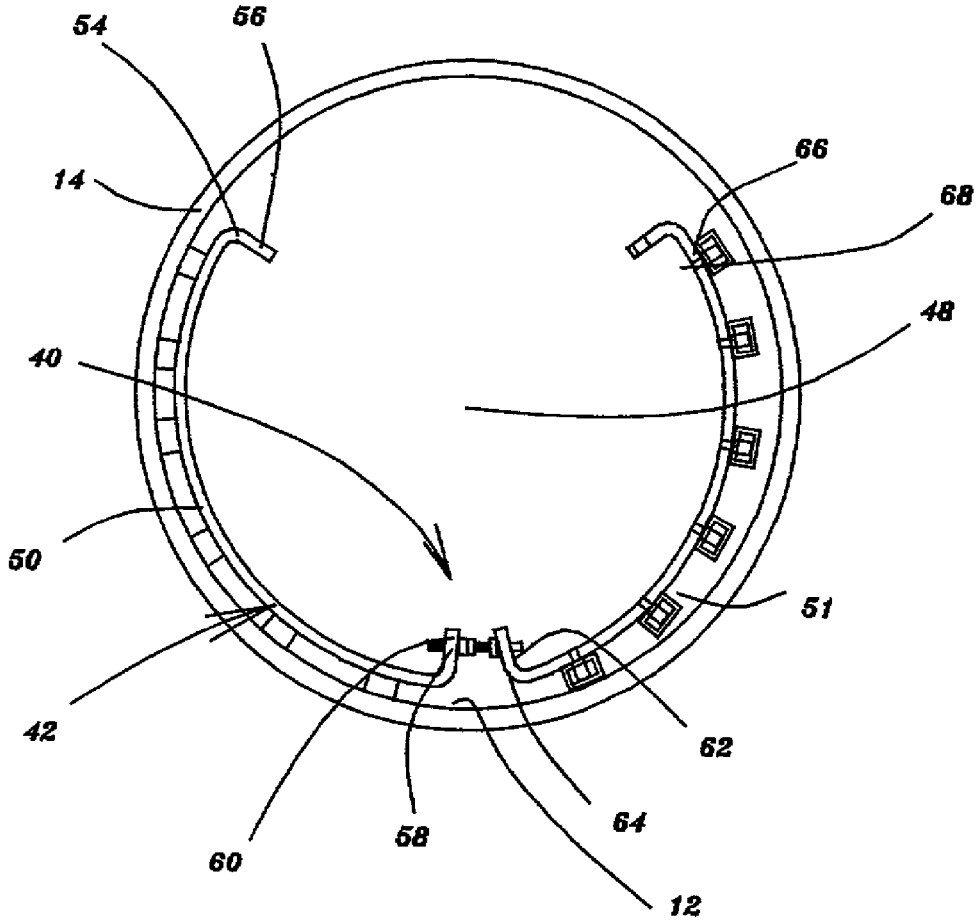
FIG. 10 is a view which is similar to FIG. 4 but shows two lower segments disposed within the dryer.

FIG. 10 is a view which is similar to FIG. 4 but shows the two lower segments 50 and 51 disposed within the dryer 14. As shown in FIG. 10, the method also includes the further step involved in the the step of inserting the pins 90 within corresponding holes 94 defined by the bars 18–35 The further step illustrated in FIG. 10 includes, pulling the segment 51 away from the inner surface 12 of the dryer 14 by a distance such that the pins 90 are located adjacent to corresponding holes 94 defined by the bars for facilitating engagement of the pins 90 within such holes 94 while preventing pins which have previously been located and engaged within corresponding holes 94 from becoming disengaged from such holes 94.

In operation of the apparatus according to the present invention a 5' diameter dryer is equipped with 18 hollow rectangular steel bars, each disposed in an axial direction and positioned adjacent to the inside surface of the paper drying cylinder. The equivalent number of bars for a 6' diameter dryer cylinder is 21.

One of these hollow rectangular bars is shown in FIG. 2. In the preferred embodiment, each axial segment of bars is held against the dryer surface with two hoop assemblies. Each hoop assembly for example hoop rings 42 and 43 consists of 3 segments, each with one threaded adjuster 70 or fastener between the segments 50 and 51, 51 and 52, 50 and 52. Each adjuster 70 has one threaded nut or movable member, for tightening the hoop rings or hoops. This nut may either be staked in position after it is tightened, or locked in position with a back-up jam nut. The threaded fasteners have guide portions or heads that are long enough to be fully engaged in holes or orifices or apertures at the end of the hoop segment. The fasteners also have socket heads to allow a manual, pneumatic, or electric ratchet to engage the socket head and drive the fastener until it is tightened. In the preferred embodiment, the fastener is long enough that a single length fastener will span a range of dryer inside diameters without being limited by the curvature of the hoop segments. One of the threaded fasteners is shown in FIG. 5.

In the preferred embodiment, the hoop ring segments are attached to the rectangular dryer bars with pins. In the preferred embodiment, the hoop has a thickness of ⅜" and the pins have a diameter of ⅜" also. Where the pins engage the hollow rectangular tube bars, the pin diameter in the preferred embodiment is larger than the diameter of the pin where it engages the hoop segment. This larger diameter is preferably 1/16" larger than the smaller diameter of the pin. One of these pins is shown is FIG. 7.

In the preferred embodiment, the pins have raised ridges or barbs on the circumference of the pins in the portion that engages in the holes in the hoop segments. These raised portions lock the pins in the hoop segments until the bars have been installed in the dryer.

Also included in this invention is the method for installing the bars. With the following procedure, the time for bar installation can be reduced to about ⅓ of the time required for assembly of prior art type configurations:

In the method according to this invention, the first two hoop segments of each hoop assembly are positioned in a circumferential direction along the bottom portion of the dryer. Threaded fasteners are positioned between these two segments, with adjusting nuts turned onto the fasteners.

Hollow rectangular bars are then slipped under the two partial hoop assemblies, one at a time, and sequentially engaged with the pins in the hoops, beginning with the bottom bar positions.

Once all of the bars have been installed in the lower two hoop segments, the top (last) segments of the hoop assemblies are placed into position, with threaded fasteners between them and their adjacent hoop segments. The last group of bars is then installed, one at a time, beginning at one end of the segment and continuing until the rest of the bars are installed.

Then the threaded fasteners are tightened, beginning with the lower two. Each fastener is tightened with a manual, electric, or pneumatic ratchet, while holding the nut with an open-end wrench. The fasteners are adjusted until the distance between the segments are about equal, then the fasteners are tightened to the final specification. This completes the installation of one axial segment. The time for this installation is about 5–10 minutes with a two-man crew.

The present invention provides a unique apparatus for increasing the heat transfer from within a dryer to the outer surface thereof while additionally providing a relatively simple system for installing such apparatus.

What is claimed is:

1. An apparatus for increasing a transfer of thermal energy through an inner surface of a hollow cylindrical dryer of a papermaking machine to a peripheral outer surface of the dryer, said apparatus comprising:

a plurality of bars of rectangular cross-sectional configuration, each of said bars extending axially within the dryer, said bars being disposed spaced and parallel relative to each other with each of said bars being urged radially outward against the inner surface of the dryer;

each of said bars defining an axially extending enclosure:

a mechanism for urging each of said bars radially outward against the inner surface of the dryer;

a plurality of hoop rings spaced axially within the dryer, each hoop ring being disposed normal to an axis of rotation of the dryer;

each hoop ring includes:

a plurality of segments;

said plurality of segments including:

a first segment which includes;

a first arm extending in a direction from the inner surface of the dryer generally towards the axis of rotation of the dryer, said first arm defining a first orifice;

a second arm extending in a direction from the inner surface of the dryer generally towards the axis of rotation of the dryer, said second arm defining a second orifice;

a second segment which includes:

a first limb extending in a direction from the inner surface of the dryer generally towards the axis of rotation of the dryer, said first limb defining a first aperture;

a second limb extending in a direction from the inner surface of the dryer generally towards the axis of rotation of the dryer, said second limb defining a second aperture;

an adjuster having a first and a second end, said adjuster extending through and being guided by said second orifice of said first segment and said first aperture of said second segment such that said first end of said adjuster is disposed adjacent to said second orifice and said second end of said adjuster is disposed adjacent to said first aperture;

said adjuster further includes;

a radially extending collar disposed between said first and second ends of said adjuster, said collar bearing against said first limb when said second end of said adjuster is extending through said first aperture;

a guide portion extending between said collar and said second end of said adjuster for guiding said second end of said adjuster within said first aperture;

a threaded portion extending between said collar and said first end of said adjuster such that said threaded portion extends through said second orifice; and a movable member threadably cooperating with said threaded portion so that said movable member bears against said second arm when said threaded portion extends through said second orifice, the arrangement being such that when said threaded portion is rotated relative to said movable member, said movable member and said collar move away from each other so that said second arm of said first segment is urged away from said first limb of said second segment such that said hoop ring is expanded for urging each of said bars outwardly away from said axis of rotation of the dryer towards the inner surface of the dryer.

2. An apparatus as set forth in claim 1 wherein each of said bars is fabricated from metallic material.

3. An apparatus as set forth in claim 1 wherein each of said bars is fabricated from steel.

4. An apparatus as set forth in claim 1 wherein each of said bars is fabricated from low-carbon steel.

5. An apparatus as set forth in claim 1 wherein each of said bars is fabricated from stainless steel.

6. An apparatus as set forth in claim 1 wherein said plurality of bars is within a range of 12 to 30 bars.

7. An apparatus as set forth in claim 1 wherein said plurality of bars is within a range of 15 to 24 bars.

8. An apparatus as set forth in claim 1 wherein said plurality of bars is 18 bars.

9. An apparatus as set forth in claim 1 wherein said plurality of bars is 21 bars.

10. An apparatus as set forth in claim 1 wherein said plurality of bars is within a range which is 3 to 4 times an outside diameter of the dryer when said outside diameter is expressed in feet.

11. An apparatus as set forth in claim 1 wherein each of said bars is equally spaced relative to an adjacent bar.

12. An apparatus as set forth in claim 1 wherein each of said bars has a cross-sectional dimension within a range of 0.25" in width by 0.25" in depth to 1.50" in width by 1.00" in depth.

13. An apparatus as set forth in claim 1 wherein each of said bars has a square cross-sectional configuration.

14. An apparatus as set forth in claim 1 wherein each of said bars has an outside width of 1" and an outside depth of ¾".

15. An apparatus as set forth in claim 2 wherein each of said bars has an outside width and an outside depth and an inside width and an inside depth such that:

1) a total cross-sectional area of a bar is a product of said outside width and said outside depth;

2) a cross-sectional area of said enclosure is a product of said inside width and said inside depth;

3) a cross-sectional area of said metallic bar is said total cross-sectional area (1) less said cross-sectional area (2) of said enclosure, the arrangement being structured such that said cross-sectional area (3) of said metallic bar is at least 25% less than said total cross-sectional area (1).

16. An apparatus as set forth in claim 2 wherein each of said bars has an outside width and an outside depth and an inside width and an inside depth such that:

1) a total cross-sectional area of a bar is a product of said outside width and said outside depth;

2) a cross-sectional area of said enclosure is a product of said inside width and said inside depth;

3) a cross-sectional area of said metallic bar is said total cross-sectional area (1) less said cross-sectional area (2) of said enclosure, the arrangement being structured such that said cross-sectional area (3) of said metallic bar is at least 50% less than said total cross-sectional area (1).

17. An apparatus as set forth in claim 2 wherein each of said bars has an outside width and an outside depth and an inside width and an inside depth such that:

1) a total cross-sectional area of a bar is a product of said outside width and said outside depth;

2) a cross-sectional area of said enclosure is a product of said inside width and said inside depth;

3) a cross-sectional area of said metallic bar is said total cross-sectional area (1) less said cross-sectional area (2) of said enclosure, the arrangement being structured such that said cross-sectional area (3) of said metallic bar is at least 75% less than said total cross-sectional area (1).

18. An apparatus as set forth in claim 1 wherein each hoop ring includes:

three segments.

19. An apparatus as set forth in claim 1 wherein said guide portion defines a socket structured for receiving therein a driving attachment of a power tool.

20. An apparatus as set forth in claim 1 wherein said guide portion defines an external hex type arrangement structured for receiving thereover a driving attachment of a power tool.

21. An apparatus as set forth in claim 1 further including:

a pin which extends between a bar of said plurality of bars and an adjacent hoop ring of said plurality of hoop rings for supporting said bar relative to said hoop ring.

22. An apparatus as set forth in claim 21 wherein said pin includes:

a first portion for insertion thereof within a hole defined by said bar, said first portion having a first and a second extremity such that when said first extremity of said first portion is inserted into said hole, said first portion is disposed within said enclosure and said second extremity of said first portion is disposed adjacent to said hole;

a second portion having a first and a second end and an outer surface, said second portion extending from said second extremity of said first portion, said second portion being inserted into a further hole defined by said hoop ring.

23. An apparatus as set forth in claim 22 wherein said first portion has a greater diameter than said second portion so that when said second portion is inserted into said further hole of said hoop ring, insertion of said first portion of said pin into said further hole of said hoop ring is inhibited.

24. An apparatus as set forth in claim 22 wherein said first portion has a diameter of at least 0.25".

25. An apparatus as set forth in claim 22 wherein said first portion has a diameter of at least 1/16" larger than said second portion, but less than the width of said bar enclosure.

26. An apparatus for increasing a transfer of thermal energy through an inner surface of a hollow cylindrical dryer of a papermaking machine to a peripheral outer surface of the dryer, said apparatus comprising:

a plurality of bars of rectangular cross-sectional configuration, each of said bars extending axially within the dryer, said bars being disposed spaced and parallel relative to each other with each of said bars being urged radially outward against the inner surface of the dryer;

each of said bars defining an axially extending enclosure;

a mechanism for urging each of said bars radially outward against the inner surface of the dryer;

said mechanism including;

a plurality of hoop rings spaced axially within the dryer, each hoop ring being disposed normal to an axis of rotation of the dryer;

a pin which extends between a bar of said plurality of bars and an adjacent hoop ring of said plurality of hoop rings for supporting said bar relative to said hoop ring;

said pin including:

a first portion for insertion thereof within a hole defined by said bar, said first portion having a first and a second extremity such that when said first extremity of said first portion is inserted into said hole, said first portion is disposed within said enclosure and said second extremity of said first portion is disposed adjacent to said hole;

a second portion having a first and a second end and an outer surface, said second portion extending from said second extremity of said first portion, said second portion being inserted into a further hole defined by said hoop ring; and said outer surface of said second portion defining at least one barb which engages said further hole when said second portion is inserted therein so that connection of said bar to said hoop ring is permitted.

27. An apparatus for increasing a transfer of thermal energy through an inner surface of a hollow cylindrical dryer of a papermaking machine to a peripheral outer surface of the dryer, said apparatus comprising:

a plurality of bars of rectangular cross-sectional configuration, each of said bars extending axially within the dryer, said bars being disposed spaced and parallel relative to each other with each of said bars being urged radially outward against the inner surface of the dryer;

each of said bars defining an axially extending enclosure;

a mechanism for urging each of said bars radially outward against the inner surface of the dryer;

said mechanism including:

a plurality of hoop rings spaced axially within the dryer, each hoop ring being disposed normal to an axis of rotation of the dryer;

a pin which extends between a bar of said plurality of bars and an adjacent hoop ring of said plurality of hoop rings for supporting said bar relative to said hoop ring;

said pin including:

a first portion for insertion thereof within a hole defined by said bar, said first portion having a first and a second extremity such that when said first extremity of said first portion is inserted into said hole, said first portion is disposed within said enclosure and said second extremity of said first portion is disposed adjacent to said hole;

a second portion having a first and a second end and an outer surface, said second portion extending from said second extremity of said first portion, said second portion being inserted into a further hole defined by said hoop ring; and said outer surface of said second portion defining at least one groove lock which engages said further hole when said second portion is inserted therein so that connection of said bar to said hoop ring is permitted.

28. An apparatus for increasing a transfer of thermal energy through an inner surface of a hollow cylindrical dryer of a papermaking machine to a peripheral outer surface of the dryer, said apparatus comprising:

a plurality of bars of rectangular cross-sectional configuration, each of said bars extending axially within the dryer, said bars being disposed spaced and parallel relative to each other with each of said bars being urged radially outward against the inner surface of the dryer;

each of said bars defining an axially extending enclosure;

a mechanism for urging each of said bars radially outward against the inner surface of the dryer;

said mechanism including;

a plurality of hoop rings spaced axially within the dryer, each hoop ring being disposed normal to an axis of rotation of the dryer;

a pin which extends between a bar of said plurality of bars and an adjacent hoop ring of said plurality a first portion for insertion thereof within a hole defined by said bar, said first portion having a first and a second extremity such that when said first extremity of said first portion is inserted into said hole, said first portion is disposed within said enclosure and said second extremity of said first portion is disposed adjacent to said hole;

a second portion having a first and a second end and an outer surface, said second portion extending from said second extremity of said first portion, said second portion being inserted into a further hole defined by said hoop ring; and said outer surface of said second portion is an interference fit with said further hole when said second portion is inserted therein so that connection of said bar to said hoop ring is permitted.

29. An apparatus for increasing a transfer of thermal energy through an inner surface of a hollow cylindrical dryer of a papermaking machine to a peripheral outer surface of the dryer, said apparatus comprising:

a plurality of bars of rectangular cross-sectional configuration, each of said bars extending axially within the dryer, said bars being disposed spaced and parallel relative to each other with each of said bars being urged outwardly against the inner surface of the dryer;

a plurality of hoop rings spaced axially within the dryer, each hoop ring being disposed normal to an axis of rotation of the dryer with said plurality of bars disposed between said plurality of hoop rings and the inner surface of the dryer;

a pin which extends between a bar of said plurality of bars and an adjacent hoop ring of said plurality of hoop rings for supporting said bar relative to said hoop ring;

said pin including:

a first portion for insertion thereof within a hole defined by said bar, said first portion having a first and a second extremity such that when said first extremity of said first portion is inserted into said hole, said first portion is disposed within said enclosure and said second extremity of said first portion is disposed adjacent to said hole; and a second portion having a first and a second end and an outer surface, said second portion extending from said second extremity of said first portion, said second portion being inserted into a further hole defined by said hoop ring.

30. A method for installing a plurality of hollow rectangular bars inside a dryer cylinder of a papermaking machine such that the bars extend parallel and spaced relative to each other so that the bars extend axially within the cylinder, said method comprising the steps of:

inserting pins into unconnected segments of a hoop ring;

locating the segments within the dryer cylinder;

locating a plurality of hollow bars within the dryer cylinder;

inserting the pins within corresponding holes defined by the bars so that a segment and corresponding bars are connected to each other;

positioning an adjuster between adjacent segments so that the adjacent segments with an adjuster therebetween cooperate together to generate the hoop ring, the bars being disposed between the hoop ring and an inner surface of the dryer cylinder; and rotating at least one of the adjusters relative to a movable member which threadably cooperates with the adjuster so that the hoop ring is expanded for urging the bars against the inner surface of the dryer cylinder, the movable member threadably cooperating with a threaded portion of the adjuster so that the movable member bears against a second arm when the threaded portion extends through a second orifice of the second arm, the arrangement being such that when the threaded portion is rotated relative to the movable member, the movable member and a collar defined by the adjuster move away from each other such that the hoop ring is expanded for urging each of the bars outwardly away from the axis of rotation of the dryer towards the inner surface of the dryer.

31. A method as set forth in claim 30 wherein the step of positioning an adjuster further includes:

positioning an adjuster between adjacent lower segments of the hoop ring;

subsequently, positioning further adjusters between the lower segments and at least one upper segment for completing the hoop ring.

32. A method as set forth in claim 30 wherein the step of inserting the pins within corresponding holes defined by the bars further includes:

pulling the segment away from the inner surface of the dryer cylinder by a distance such that the pins are located adjacent to corresponding holes defined by the bars for facilitating engagement of the pins within such holes while preventing pins which have previously been located and engaged within corresponding holes from becoming disengaged from such holes.

* * * * *